United States Patent [19]

Wolf

[11] 4,095,719

[45] Jun. 20, 1978

[54] EDGE EXTRUSION AND ASSOCIATED CASING HARDWARE

[75] Inventor: Walter C. Wolf, Rancho Palos Verdes, Calif.

[73] Assignee: Thermodyne International Ltd., Hawthorne, Calif.

[21] Appl. No.: 726,926

[22] Filed: Sep. 27, 1976

[51] Int. Cl.[2] ..... B65D 7/32; B65D 7/44; B65D 43/16

[52] U.S. Cl. ..... 220/4 B; 190/49; 220/73; 220/324; 220/334

[58] Field of Search ..... 220/71, 73, 4 B, 4 E, 220/324, 334; 190/49

[56] References Cited

U.S. PATENT DOCUMENTS

| | | | |
|---|---|---|---|
| 2,803,368 | 8/1957 | Koch | 220/4 B |
| 3,088,623 | 5/1963 | Parker | 220/324 |
| 3,181,726 | 5/1965 | Parker | 220/324 |
| 3,290,853 | 12/1966 | Pucci | 220/334 |
| 3,579,804 | 5/1971 | Slan | 190/49 |
| 3,811,747 | 5/1974 | Levin | 220/324 |

*Primary Examiner*—George E. Lowrance
*Attorney, Agent, or Firm*—W. Edward Johansen

[57] ABSTRACT

The present invention is an edge extrusion which is attached on the peripheral rim and to the sidewall of a shell of a plastic container. The edge extrusion has either a male or female joining edge. A rubber gasket is placed between the male and female joining edges in order to seal the plastic container. The present invention also includes casing hardware such as hinges, clamp assemblies and handles, all of which have a base which is adapted to be attached and secured to the edge extrusion without the use of rivets or epoxy. The edge extrusion has a pair of L-shaped flanges, oppositely disposed to each other and parallel to the plane of the sidewall of the container. The base is a rectangular member adapted to loosely slide between the two L-shaped flanges and it has a set of flanges protruding from one of its longitudinal sides. The base has a set of semi-circularly cut holes disposed adjacent to its other longitudinal side and adapted so that a portion of the base between the other longitudinal edge and the semi-circularly cut hole may be deformed in order to secure the base within the L-shaped flanges of the edge extrusion. The edge extrusion is adapted to extend along the entire peripheral rim of the shell and closes on itself. The edge extrusion has a set of ridges disposed on its surface contacting the sidewall of the shell in order to provide additional secureness of the edge extrusion to the sidewall of the shell.

3 Claims, 12 Drawing Figures

Fig. 1.
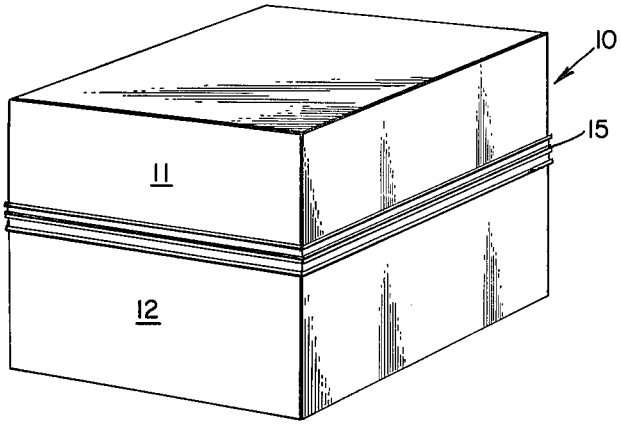
Fig. 2.
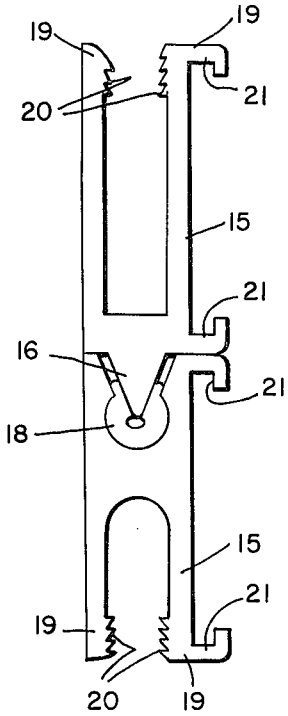
Fig. 3.
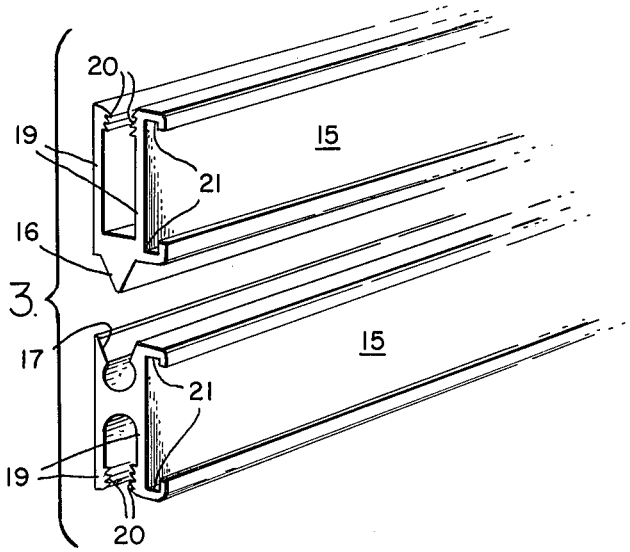
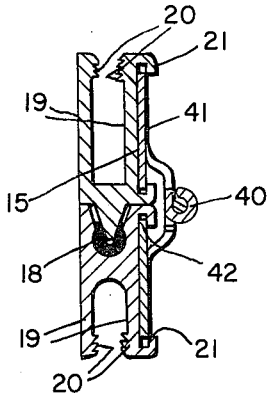
Fig. 5.
Fig. 4.
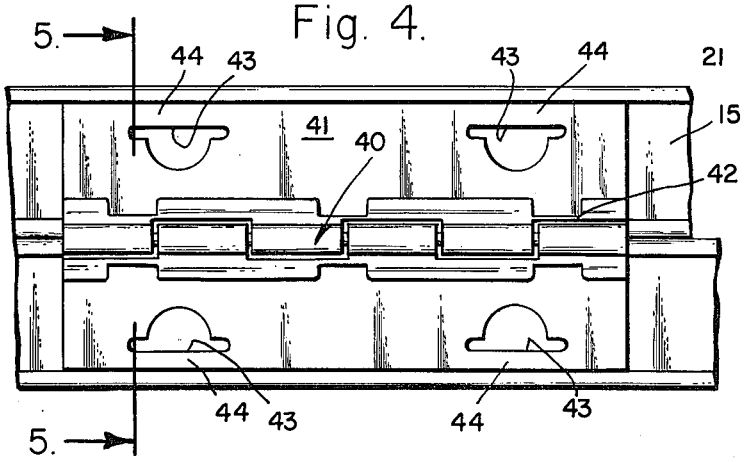
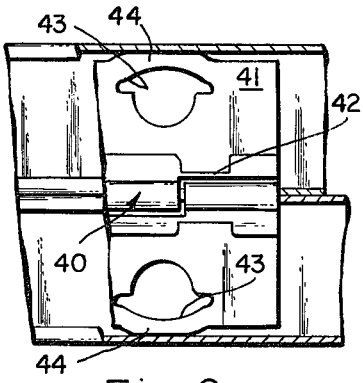
Fig. 6.

Fig. 7.
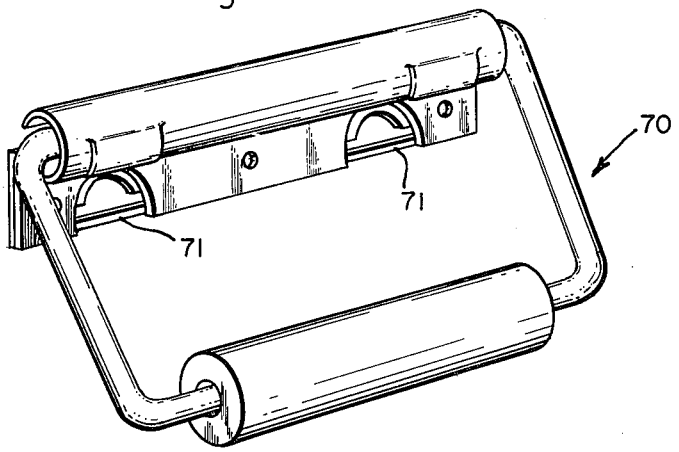
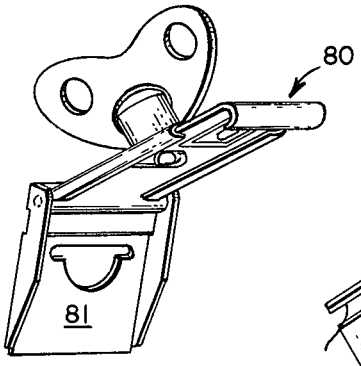
Fig. 8.
Fig. 10.
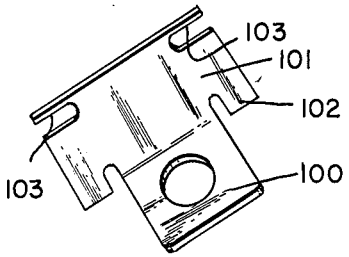
Fig. 11.
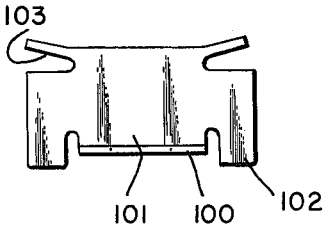
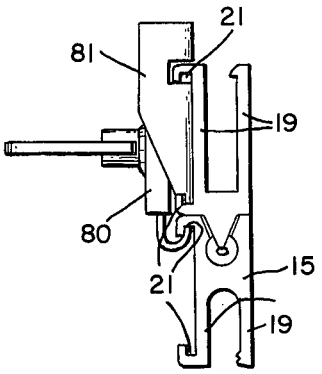
Fig. 9.
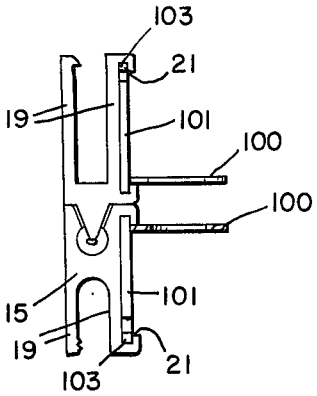
Fig. 12.

EDGE EXTRUSION AND ASSOCIATED CASING HARDWARE

BACKGROUND OF THE INVENTION

1. Field of the Invention

The present invention relates to edge extrusions which are mounted on the top shell and bottom shell of a plastic case, and more particularly to edge extrusions to which casing hardware is attached and secured by crimping.

2. Description of the Prior Art

Presently cases are used to transport equipment from location to another. At its destination, the equipment is removed for use. The standard case is that of a "Clam Shell" design and has a top shell and a bottom shell. The case also has a pair of edge extrusions, one of which has a male edge and the other of which has a female edge, which are mounted on the peripheral rims of the top and bottom shells. The case further has a rubber gasket which is adapted to be placed between the male and female edges of the edge extrusions so that the case may be sealed.

The edge extrusions are generally formed from aluminum and when they are coupled together they formed an H-shaped member in a cross-sectional view. The peripheral rim of each shell is inserted into the space between the vertical portions of the H-shaped member and is secured thereto by epoxy. Once the edge extrusions are secured to the peripheral rims of the top and bottom shells casing hardware may be attached to the edge extrusions.

The casing hardward includes hinges, non-separable and slip hinges, locks, handles and clamps assemblies. In the prior art there are many methods of attaching and securing the casing hardware to the edge extrusions, but all these methods have drawbacks when they are used on a case which must not only be reusable, but also air-tight. Presently the preferred method of attaching and securing casing hardware to the edge extrusions consists of riveting the base of the casing hardware to the edge extrusion. The riveting produces a very secure joining of the base of the casing hardware and the edge extrusion, but the riveting also produces a hole in the sidewall of the shell thereby creating a leak in the case. Another problem arises when the casing hardware becomes damaged and must be replaced in order to reuse the case. If the casing hardware must be replaced in the field, it may be difficult to find a riveting machine. Furthermore, even if a riveting machine is available, it will create another set of holes in order to mount and secure the base of the casing hardware.

Another method of attaching and securing casing hardware to the edge extrusions consists of epoxying the base of the casing hardware to the edge extrusion. The epoxying produces a very secure joining of the base of the casing hardware to the edge extrusion. The epoxying produces a very secure joining of the base of casing hardware and the edge extrusion and it does not create a leak in the case. The problem with epoxying is that when the casing hardware becomes damaged and must be replaced, it is very difficult to remove the damaged casing hardware in order to replace it.

Reference to Environmental Container Systems' Standard Case Catalog provides one with a good example of casing hardware and edge extrusions which may be joined by riveting. Attention is also called to the smooth interior surface of vertical portions of the H-shaped member. The smooth interior surface is coupled to the sidewall of the shell by epoxy, but in some applications a more secure joining of the edge extrusion to the shell is desired. The only way to make a more secure joining is to rivet the edge extrusion to the shell, but riveting creates a leak in the case.

Reference to Hardigg Industries' Reusable Container Catalog provides one with a good example of an alternative to the use of edge extrusions. The Hardigg Industries' Catalog shows a double wall configuration at the case parting line. The casing hardware is attached to the double wall of the case by either rivets or epoxy. The double wall is molded into a male member and a female member and is sealed by a rubber gasket.

Reference to Skydyne's Catalog provides one with several examples of the various shapes that these cases may take. In all of these cases the edge extrusions extend completely around the peripheral rims of the top and bottom shells. These shells are generally formed out of plastic materials or fiberglass.

Reference to Zero Manufacturing Co.'s Deep Drawn Military Case Catalog provides one with a good example of an aluminum case shell to which casing hardware is attached and secured by rivets. The closure shown in this catalog is similar to the closure taught in U.S. Pat. No. 3,817,419, entitled Latch to Secure a Closure on a Container, issued to Jens L. Moller and Herbert S. Ruekberg on June 18, 1974. U.S. Pat. No. 3,817,419 teaches a latch mechanism carried by the peripheral skirt of a container closure.

SUMMARY OF THE INVENTION

In view of the foregoing problems and conditions characteristic of the prior art, it is a primary object of the present invention to provide a pair of edge extrusions for use with a plastic container having a top shell and a bottom shell to which cassing hardware may be coupled without the use of epoxy or rivets.

It is another object of the present invention to provide a pair of edge extrusions that can be not only coupled to the sidewall of the shell about its peripheral rim with expoxy, but that can also be coupled to the sidewall by having its vertical sides crimped against the sidewall.

It is still another object of the present invention to provide a pair of edge extrusions to which casing hardware may be coupled and secured thereto without creating any leaks in the plastic container.

It is yet another object of the present invention to provide a pair of edge extrusions that has casing hardware coupled to it which can be easily removed and replaced in the field without specialized tooling.

In accordance with an embodiment of the present invention a pair of edge extrusions and a set of casing hardware, which is adapted to be coupled to the edge extrusions, have been described for use in a plastic container having a top shell and a bottom shell. Each shell has a peripheral rim and a sidewall. The pair of edge extrusions includes a first member which is adapted to longitudinally extend along the peripheral rim of the top shell and a second member which is adapted to longitudinally extend along the peripheral rim of the bottom shell. Both of these member close on themselves and have a pair of parallel vertical portions which are adapted to be coupled to the sidewalls of the shells. The first member has a male joining edge running parallel to its longitudinal portion and a pair of exterior flanges coupled to one of its two vertical portions and disposed so that they run parallel to the male joining edge. The second member has a female joining edge running parallel to its longitudinal portion and a pair of exterior flanges coupled to one of its two vertical portions and disposed so that they run parallel to the female joining edge. A rubber gasket couples the male joining edge to the female joining edge. The casing hardware includes an attaching device that has a rectangular base member, which is adapted to loosely slide between a pair of the exterior flanges, having a set of flanges adapted for insertion into one of the exterior flanges running longitudinally along the base member on one of its sides and a set of semi-circularly cut holes adjacent to its other sides and adapted so that a portion of the base member between its other other edge and the semi-circularly cut hole may be forced against one of the exterior flanges and the flanges may be forced against the other exterior flange. The casing hardware includes hinges, clamping assemblies and handles, all of which are attached and secured to the edge extrusions by the attaching device.

The features of the present invention which are believed to be novel are set forth with particularity in the appended claims Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE DRAWINGS

FIG. 1 is a perspective drawing of a plastic container which has an edge extrusion on its top shell and an edge extrusion on its bottom shell with both edge extrusions being constructed in accordance with the principles of the present invention.

FIG. 2 is a cross-sectional view of the two edge extrusions of FIG. 1 shown sealed together by a rubber gasket.

FIG. 3 is a perspective drawing of a section of the two edge extrusions of FIG. 1.

FIG. 4 is a plan view of a hinge having a base which is adapted to be attached and secured to the edge extrusion of FIG. 1 in accordance with the principles of the present invention.

FIG. 5 is a cross-sectional view of the hinge of FIG. 4 before it has been secured to the edge extrusion.

FIG. 6 is a plan view of the hinge of FIG. 4 after it has been secured to the edge extrusion.

FIG. 7 is a perspective view of a clamp assembly having a base which is adapted to be attached and secured to the edge extrusion of FIG. 1 in accordance with the principles of the present invention.

FIG. 8 is a side view of the clamp assembly of FIG. 7 after it has been attached and secured to the edge extrusion.

FIG. 9 is a perspective drawing of a handle having a base which is adapted to be attached and secured to the edge extrusion of FIG. 1 in accordance with the principles of the present invention.

FIG. 10 is a perspective drawing of a lock assembly member having a base which is adapted to be attached and secured to the edge extrusion of FIG. 1 in accordance with the principles of the present invention.

FIG. 11 is a plan view of the lock assembly member of FIG. 10 wherein the base has been deformed in order to secure it within the edge extrusion of FIG. 1.

FIG. 12 is a side view of the lock assembly member of FIG. 10 after it has been attached and secured to the edge extrusion of FIG. 1.

DESCRIPTION OF THE PREFERRED EMBODIMENT

The present invention is used in a plastic container 10 shown in FIG. 1 having a top shell 11 and a bottom shell 12. Both shells 11 and 12 have sidewalls and peripheral rims. The present invention is an edge extrusion 15. It can best be understood by reference to a description of its preferred embodiment. Referring briefly to FIG. 1 the edge extrusion 15 is shown extending along the peripheral rim of the top shell 11 and the peripheral rim of the bottom shell 12 and closing on itself.

Referring now to FIG. 2 the edge extrusion 15 has either a male joining edge 16 or a female joining edge 17, both of which are adapted to be coupled together. A rubber gasket 18 is provided in order to seal the plastic container 10. The edge extrusion 15 has vertical portions 19 which are adapted to slideably fit over the sidewalls of the shells 11 and 12. In the preferred embodiment of the edge extrusion 15 the inner surfaces of the vertical portions 19 have ridges 20 disposed so that they secure the edge edge extrusions 15 to the sidewalls of the shells 11 and 12 after they have been crimped against the sidewalls.

In an alternative embodiment of the edge extrusion 15 the inner surfaces of the vertical portions 19 are smooth and flat. In both of these embodiments the edge extrusion 15 is secured by cementing or by some form of chemical bonding in order to make bond between the sidewalls of the shells 11 and 12 and the edge extrusions 15 air-tight.

Still referring to FIG. 2 the edge extrusion 15 has a pair of L-shaped flanges 21 that are oppositely disposed along its longitudinal edges so that the bases of the L-shaped flanges 21 faced inward toward each other. Referring now to FIG. 3 in conjunction with FIG. 2 the L-shaped flanges 21 extend the length of the edge extrusions 15.

The plastic container 10 is used to transport various instruments and devices that require protection. There is therefore a requirement that the plastic container be sealed and secured. The plastic container 10 is sealed and secured by casing hardware which includes hinges, locks, handles and clamp assemblies. The inventor has used standard casing hardware to seal and secure the plastic container 10, but he has added a new base in order to attach and secure the casing hardware to the edge extrusion 15 of the present invention. It is this new base operating in conjunction with the edge extrusion 15 that provides the plastic container 10 with unique advantages. In order to understand these advantages it is necessary to refer to FIG. 4. where a hinge 40 has a rectangular base member 41 which is adapted to loosely slide between each of the pair of L-shaped flanges 21 and which has a set of flanges 42 adapted for insertion into one of the pair of L-shaped flanges 21 and disposed along one longitudinal edge of the rectangular base member 41. The rectangular base member 41 also has a set of semi-circularly cut holes 43 adjacent to its other longitudinal edge and is adapted so that a portion 44 between its other edge and the semi-circularly cut hole 43 may be forced against one of the L-shaped flanges 21 and so that the flanges 42 may be forced against the other L-shaped flange 21 in order to attach and secure the base member 41 to the edge extrusion 15.

The hinge 40 is shown after it has been inserted into the edge extrusion 16, but before it has been secured, in FIG. 5. FIG. 6 shows the portion 44 adjacent to the semi-circularly cut hole 43 deformed into the L-shaped flange 21 of the edge extrusion 15.

Referring now to FIG. 7 the casing hardware also includes a handle 70 having a rectangular base member 71 similar to the rectangular base member 41 of the hinge 40. The handle 70 is riveted to the rectangular base member 71 and then is attached and secured to the edge extrusion 15.

Referring to FIG. 8 in conjunction with FIG. 9 a conventional clamp assembly 80 has a rectangular base member 81 that is also similar to the rectangular base member 41 of the hinge 40. FIG. 9 shows the clamp assembly 80 attached and secured to one edge extrusion 15 and coupling that edge extrusion 15 to another edge extrusion 15.

FIG. 10 is a perspective drawing of a locking assembly member 100 having a rectangular base member 101 with flanges 102 along one longitudinal edge and two U-shaped holes 103 at the corners of the base member 101 adjacent to the other longitudinal edge. FIG. 11 shows the base member 101 after the U-shaped holes 103 have been deformed in order to secure the locking assembly member 100 in the edge extrusion 15.

FIG. 12 shows two locking assembly members 100, attached and secured to two edge extrusions 15, forming a locking assembly that requires only a padlock to be complete.

From the foregoing it can be seen that an edge extrusion and a set of casing hardware has been described. The edge extrusion has L-shaped flanges adapted to receive a specialized base member for casing hardware. The advantage of this specialized base member is that not only can the casing hardware be secured to the edge extrusion without creating a leak in the plastic container to which it is attached, but it can also be easily and quickly removed without the use of sophiscated tooling such as a riveting machine and then replaced in the field. The life of the hardware, which is more likely to be damaged than the plastic container or the edge extrusions, limits the life of the plastic container if it can not be easily replaced.

It should be noted that the schematics of the edge extrusion and the casing hardware are not drawn to scale and that the distances of and between figures are not to be considered significant.

Accordingly, it is intended that the foregoing disclosure and showings made in the drawing shall be considered only as illustrations of the principles of the present invention.

What is claimed is:

1. For use in a plastic container, which includes a top shell and a bottom shell, each shell having a peripheral rim and a sidewall, casing hardware used in combination with a pair of edge extrusions that include:

a. a first member which is adapted to longitudinally extend along the peripheral rim of the top shell so that it closes on itself and which has two parallel vertical portions which are adapted to be coupled to the sidewall of the top shell, said first member having a male joining edge running parallel to its longitudinal portion and a pair of exterior flanges coupled to one of said two vertical portions and male joining edge;

b. a second member which is also adapted to longitudinally extend along the peripheral rim of the bottom shell so that it closes on itself and which has two parallel vertical portions which are adapted to be coupled to the sidewall of the bottom shell; said second member having a female joining edge running parallel to its longitudinal portion and a pair of exterior flanges coupled to one of said two vertical portions and disposed so that said exterior flanges run parallel to said female joining edge; and c. a rubber gasket is coupled between said male joining edge and said female joining edge thereby sealing said plastic container, said casing hardware comprising:

a. A rectangular base member, which is adapted to loosely slide between each of said pair of exterior flanges, having a set of flanges adapted for insertion into one of said exterior flanges running longitudinally along said base member on one of its sides and a set of semi-circularly cut holes adjacent to its other edges and adapted so that a portion of said base member between its other edge and said semicircularly cut hole may be forced against one of said exterior flanges and said flanges may be forced against the other of said exterior flanges thereby effecting the attaching and securing of said base member to said edge extrusion; and b. joining means for joining the top shell to the bottom shell, said joining means mechanically coupled to said rectangular member.

2. For use in a plastic container, which includes a top shell and a bottom shell, each shell having a peripheral rim and a sidewall, a pair of edge extrusions according to claim 1 wherein said vertical portions of said first and second members on ridges running longitudinally along where they contact the sidewalls of the shells.

3. For use in a plastic container, which includes a top shell and a bottom shell, each shell having a peripheral rim and a sidewall, casing hardware used in combination with a pair of edge extrusions that include:

a. a first member which is adapted to longitudinally extend along the peripheral rim of the top shell so that it closes on itself and which has two parallel vertical portions which are adapted to be coupled to the sidewall of the top shell, said first member having a male joining edge running parallel to its longitudinal portion and a pair of exterior flanges coupled to one of said two vertical portions and disposed so that said exterior flanges run parallel to said male joining edge;

b. a second member which is also adapted to longitudinally extend along the peripheral rim of the bottom shell so that it closes on itself and which has two parallel vertical portions which are adapted to be coupled to the sidewall of the bottom shell; said second member having a female joining edge running parallel to its longitudinal portion and a pair of exterior flanges coupled to one of said two vertical portions and disposed so that said exterior flanges run parallel to said female joining edge; and c. a rubber gasket is coupled between said male joining edge and said female joining edge thereby sealing said plastic container, said casing hardware comprising:

a. a rectangular base member, which is adapted to loosely slide between each of said pair of exterior flanges, having a set of flanges adapted for insertion into one of said exterior flanges running longitudinally along said base member on one of its sides and a pair of U-shaped holes disposed in the corners of said base member adjacent to its other side and adapted so that a portion of said member between its other edge and said U-shaped hole may be forced against one of said exterior flanges and said flanges may be forced against the other of said exterior flanges thereby effecting the attaching and securing of said base member to said edge extrusion; and b. joining means for joining the top shell to the bottom shell, said joining means mechanically coupled to said rectangular base member.

* * * * *